US011654588B2

(12) United States Patent
Nisby et al.

(10) Patent No.: US 11,654,588 B2
(45) Date of Patent: May 23, 2023

(54) RAZOR BLADES

(71) Applicant: The Gillette Company LLC, Boston, MA (US)

(72) Inventors: John Joseph Nisby, Hanson, MA (US); Matthew Robert Stone, Oxford, MA (US); Yongqing Ju, Kronberg (DE); Ronald Richard Duff, Jr., Shrewsbury, MA (US)

(73) Assignee: The Gillette Company LLC, Boston, MA (US)

( * ) Notice: Subject to any disclaimer, the term of this patent is extended or adjusted under 35 U.S.C. 154(b) by 931 days.

(21) Appl. No.: 15/671,578

(22) Filed: Aug. 8, 2017

(65) Prior Publication Data

US 2018/0043561 A1 Feb. 15, 2018
US 2018/0043561 A1 Feb. 15, 2018

Related U.S. Application Data

(60) Provisional application No. 62/375,380, filed on Aug. 15, 2016.

(51) Int. Cl.
*B26B 21/56* (2006.01)
*B05D 7/00* (2006.01)
(Continued)

(52) U.S. Cl.
CPC ..... *B26B 21/56* (2013.01); *B05D 7/50* (2013.01); *B26B 21/4031* (2013.01); *B26B 21/60* (2013.01)

(58) Field of Classification Search
CPC ..... B26B 21/54; B26B 21/56; B26B 21/58; B26B 21/60
(Continued)

(56) References Cited

U.S. PATENT DOCUMENTS 3,292,478 A 12/1966 Adolf et al.
3,761,372 A * 9/1973 Sastri ..... B26B 21/54 30/346.55
(Continued)

FOREIGN PATENT DOCUMENTS

GB 1097862 A 1/1968
GB 1179829 A 2/1970
(Continued)

OTHER PUBLICATIONS

PCT Search Report and Written Opinion for PCT/US2017/046200 dated Nov. 20, 2017, 11 pages.

*Primary Examiner* — Jason Daniel Prone
(74) *Attorney, Agent, or Firm* — Kevin C. Johnson; Joanne N. Pappas

(57) ABSTRACT

A razor blade having a substrate with a cutting edge being defined by a sharpened tip. The substrate has a thickness of greater than about 2.30 micrometers measured at a distance of four micrometers from the blade tip, a thickness of greater than about 4.26 micrometers measured at a distance of eight micrometers from the blade tip, and greater than about 7.93 micrometers measured at a distance of sixteen micrometers from the blade tip. A hard coating joined to the substrate has a thickness of 700 Angstroms to about 3500 Angstroms. An outer layer joined to a coated substrate is discontinuous. The outer layer may be produced from a dispersion comprising about 0.03 g/L or less of telomer or from about 0.5 % solids or less of telomer by weight of composition. The novel razor blade cuts at less than 100 % cutting efficiency using a single fiber cutting efficiency measure.

38 Claims, 8 Drawing Sheets

(51) Int. Cl.
*B26B 21/40* (2006.01)
*B26B 21/60* (2006.01)

(58) Field of Classification Search
USPC ..... 30/346.5, 346.53–346.55, 346.58, 350, 30/357; 76/104.1, DIG. 8
See application file for complete search history.

(56) References Cited

U.S. PATENT DOCUMENTS 3,761,373 A * 9/1973 Sastri ..... B26B 21/54 30/346.55
3,761,374 A * 9/1973 Bromer et al. ..... B26B 21/54 30/346.55
3,811,189 A * 5/1974 Sastri ..... B26B 21/54 30/346.53
3,834,265 A 9/1974 Tafapolsky et al.
3,835,537 A * 9/1974 Sastri ..... B26B 21/54 30/346.53
3,873,378 A 3/1975 Webster
4,012,551 A * 3/1977 Bogaty ..... B26B 21/60 30/346.53
4,180,420 A 12/1979 Alexander et al.
4,291,463 A * 9/1981 Williams ..... B26B 21/60 30/346.53
4,416,912 A * 11/1983 Bache ..... C23C 16/44 427/248.1
4,720,918 A * 1/1988 Curry ..... B26B 21/58 30/346.5
5,032,243 A 7/1991 Bache et al.
5,048,191 A * 9/1991 Hahn ..... B26B 21/54 30/346.54
5,056,227 A * 10/1991 Kramer ..... B26B 21/54 30/346.54
5,088,202 A * 2/1992 Boland ..... B26B 21/58 30/346.54
5,129,289 A * 7/1992 Boland ..... B26B 21/58 30/346.54
5,142,785 A * 9/1992 Grewal ..... B26B 21/60 76/DIG. 8
5,232,568 A * 8/1993 Parent ..... B26B 21/60 30/346.53
5,263,256 A * 11/1993 Trankiem ..... B26B 21/60 30/346.54
5,275,672 A * 1/1994 Althaus ..... C21D 6/04 30/346.54
5,295,305 A * 3/1994 Hahn ..... B26B 21/60 30/346.53
5,305,526 A 4/1994 Althaus
5,497,550 A * 3/1996 Trotta ..... B26B 21/60 30/50
5,669,144 A * 9/1997 Hahn ..... B26B 21/60 30/346.54
5,940,975 A * 8/1999 Decker ..... B26B 21/60 30/346.54
5,985,459 A * 11/1999 Kwiecien ..... B26B 21/60 76/DIG. 8
6,105,261 A * 8/2000 Ecer ..... B26B 9/00 30/346.54
6,151,786 A * 11/2000 Hellstern ..... B26B 9/00 30/346.53
6,289,593 B1 * 9/2001 Decker ..... B26B 21/60 30/346.54
6,330,750 B1 * 12/2001 Meckel ..... B26B 9/00 30/346.54
6,389,699 B1 * 5/2002 Ecer ..... B26B 21/58 30/346.54
6,468,642 B1 10/2002 Bray et al.
6,684,513 B1 * 2/2004 Clipstone ..... B26B 21/60 30/346.53
6,962,000 B2 * 11/2005 Teeuw ..... B26B 21/56 30/346.5
7,060,367 B2 * 6/2006 Yamada ..... B26B 21/56 30/346.53
7,140,113 B2 * 11/2006 King ..... B26B 21/58 30/346.54
7,448,135 B2 11/2008 Zhuk et al.
7,531,052 B2 5/2009 Yoshiyama
7,587,829 B2 * 9/2009 King ..... B26B 21/58 30/346.54
7,785,485 B2 8/2010 Daskal et al.
7,966,909 B2 * 6/2011 Madeira ..... B26B 21/60 30/346.53
8,316,550 B2 11/2012 Howells
8,359,752 B2 * 1/2013 Bridges ..... B26B 21/222 30/50
8,621,757 B2 1/2014 Akari et al.
8,640,344 B2 2/2014 Masek et al.
9,027,443 B2 5/2015 Zhuk et al.
9,079,321 B2 * 7/2015 Claus ..... B26B 21/56
9,180,599 B2 11/2015 Papachristos et al.
9,248,579 B2 * 2/2016 DePuydt ..... B26B 21/56
9,446,443 B2 9/2016 Masek et al.
9,751,230 B2 * 9/2017 Skrobis ..... B26B 21/56
9,902,013 B2 2/2018 Uemura et al.
10,118,304 B2 * 11/2018 Duff, Jr. ..... B26B 21/60
10,549,438 B2 * 2/2020 Skrobis ..... B26B 21/60
10,953,558 B2 3/2021 Logothetidis et al.
11,230,024 B2 * 1/2022 Papatriantafyllou ... B26B 21/56
11,472,053 B2 * 10/2022 Park ..... B26B 21/60
2002/0174549 A1 11/2002 Nakatsu et al.
2002/0174649 A1 11/2002 Nozaki et al.
2003/0096060 A1 * 5/2003 Trankiem ..... B26B 21/60 76/104.1
2003/0121158 A1 * 7/2003 Clipstone ..... B26B 21/60 30/346.54
2004/0172832 A1 * 9/2004 Clipstone ..... B26B 21/60 30/50
2005/0028389 A1 * 2/2005 Wort ..... B26B 21/58 30/346.54
2005/0126016 A1 * 6/2005 Branden ..... B26B 9/02 30/346.54
2006/0201001 A1 * 9/2006 Teeuw ..... B26B 21/58 30/346.54
2006/0265885 A1 * 11/2006 Clipstone ..... B26B 21/60 30/346.54
2006/0277767 A1 * 12/2006 Sun ..... B26B 21/60 30/346.54
2007/0186424 A1 * 8/2007 Becker ..... B26B 21/60 30/294
2007/0227008 A1 10/2007 Zhuk et al.
2007/0227010 A1 10/2007 Zhuk et al.
2008/0086888 A1 * 4/2008 Scheinfeld ..... B26B 21/40 30/346.53
2010/0011595 A1 1/2010 Claus et al.
2010/0024222 A1 * 2/2010 Akari ..... B26B 21/60 30/346.54
2010/0107425 A1 5/2010 Bykowski et al.
2010/0287781 A1 * 11/2010 Skrobis ..... B26B 21/60 30/346.54
2010/0299931 A1 * 12/2010 Marchev ..... B26B 21/58 30/346.53
2011/0010950 A1 1/2011 Madeira et al.
2011/0209988 A1 * 9/2011 Madeira ..... B26B 21/60 204/192.16
2011/0314678 A1 12/2011 Peterson
2012/0060379 A1 3/2012 Culf
2012/0311865 A1 * 12/2012 Hamilton ..... B26B 21/60 30/50
2013/0014395 A1 * 1/2013 Patel ..... B26B 21/60 30/346.54
2013/0014396 A1 * 1/2013 Skrobis ..... B26B 21/56 30/346.54
2013/0031794 A1 2/2013 Duff, Jr. et al.
2014/0026424 A1 1/2014 Oglesby et al.
2014/0230252 A1 8/2014 Davos et al.
2014/0245865 A1 9/2014 Masek et al.
2015/0328789 A1 11/2015 Skrobis et al.
2016/0361828 A1 12/2016 Xu et al.

(56) References Cited

U.S. PATENT DOCUMENTS

| | | | | |
|---|---|---|---|---|
| 2017/0136640 | A1* | 5/2017 | Skrobis | B26B 21/58 |
| 2018/0043561 | A1* | 2/2018 | Nisby | B26B 21/56 |
| 2018/0215056 | A1* | 8/2018 | Logothetidis | B26B 21/60 |
| 2020/0130211 | A1* | 4/2020 | Skrobis | B26B 21/56 |
| 2020/0307006 | A1* | 10/2020 | Kontokostas | B26B 21/60 |
| 2020/0316802 | A1 | 10/2020 | Kontokostas et al. | |
| 2020/0368928 | A1* | 11/2020 | Park | B26B 21/60 |
| 2020/0368929 | A1* | 11/2020 | Park | B26B 21/60 |
| 2021/0031388 | A1* | 2/2021 | Xu | B26B 21/60 |
| 2021/0031390 | A1* | 2/2021 | Skrobis | B26B 21/60 |
| 2021/0094199 | A1* | 4/2021 | Lee | B26B 21/60 |
| 2021/0162615 | A1* | 6/2021 | Siozios | B26B 21/56 |
| 2021/0162616 | A1* | 6/2021 | Logothetidis | B26B 21/60 |
| 2021/0221014 | A1* | 7/2021 | Mavroeidis | B26B 21/60 |

FOREIGN PATENT DOCUMENTS

| | | | |
|---|---|---|---|
| GB | 1465697 | | 2/1977 |
| GB | 2258469 | A | 2/1993 |
| JP | S5036261 | A | 4/1975 |
| JP | S62116755 | A | 5/1987 |
| JP | 2002294409 | A | 10/2002 |
| JP | 2007245931 | A | 9/2007 |
| WO | 8402104 | A1 | 6/1984 |
| WO | 9935303 | A1 | 7/1999 |

* cited by examiner

RAZOR BLADES

FIELD OF THE INVENTION

This invention relates to razors and more particularly to razor blades with engaging, durable edges.

BACKGROUND OF THE INVENTION

A razor blade is typically formed of a suitable substrate material such as stainless steel, and a cutting edge is formed with a wedge-shaped configuration with an ultimate tip having a radius. Hard coatings such as diamond, amorphous diamond, diamond-like carbon-(DLC) material, nitrides, carbides, oxides or ceramics are often used to improve strength, corrosion resistance and shaving ability, maintaining needed strength while permitting thinner edges with lower cutting forces to be used. A telomer or Polytetrafluoroethylene (PTFE) outer layer can be used to provide friction reduction. Interlayers of niobium or chromium containing materials can aid in improving the binding between the substrate, typically stainless steel, and hard carbon coatings, such as DLC. Prior art razors generally are known to have thinner profiles and thinner hard coatings in attempt to increase performance from the standpoint of lower cut forces and greater comfort.

SUMMARY OF THE INVENTION

The present invention includes a razor blade having a substrate with a cutting edge being defined by a sharpened tip, the substrate having a thickness of greater than about 4.26 micrometers measured at a distance of eight micrometers from the blade tip. The substrate has a thickness of greater than about 2.30 micrometers measured at a distance of four micrometers from the blade tip. The substrate has a thickness of greater than about 7.93 micrometers measured at a distance of sixteen micrometers from the blade tip. The substrate has a thickness of about 2.77 micrometers measured at a distance of four micrometers from the blade tip. The substrate has a thickness of about 5.00 micrometers measured at a distance of eight micrometers from the blade tip. The substrate has a thickness of about 9.08 micrometers measured at a distance of four micrometers from the blade tip. The substrate has a tip radius ranging from about 50 Angstroms to about 300 Angstroms.

In another embodiment, an interlayer joined to the substrate. The interlayer includes niobium or chromium. A coating layer is joined to the interlayer. The coating layer includes carbon. The carbon layer is comprised of DLC. A thickness of the DLC ranges from about 700 Angstroms to about 3500 Angstroms. An overcoat layer is joined to the coating layer. The overcoat layer includes chromium. The coated substrate has a tip radius ranging from about 50 Angstroms to about 400 Angstroms. An outer layer is joined to the overcoat layer, which includes a polymer. The outer layer includes polytetrafluoroethylene.

In another embodiment, the outer layer is discontinuous. The outer layer may be a discontinuous layer which is random, ordered, semi-ordered, or any combination thereof.

In yet another embodiment, the outer layer is produced from a dispersion comprising of about 0.5% solids or less by weight of composition of telomer. The outer layer is produced from a dispersion comprised of about 0.03 g/L or less of telomer. A thickness of the outer layer is about 100 Angstroms. A wool felt cut force of the razor blade is greater than about 2 lbs.

The razor blade of the present invention cuts at less than 100% cutting efficiency using a single fiber cutting efficiency measure.

The substrate is a martensitic stainless steel. A ratio of thickness measured at four micrometers from the blade tip to the thickness measured at eight micrometers from the blade tip is at least 0.55 and a ratio of thickness measured at four micrometers from the blade tip to the thickness measured at sixteen micrometers from the blade tip is at least 0.30.

The razor blade of the present invention is disposed within a razor cartridge.

In another embodiment, a razor blade includes a substrate with a cutting edge being defined by a sharpened tip, the substrate having a thickness of between about 2.30 and about 3.00 micrometers measured at a distance of four micrometers from the blade tip, a thickness of between about 4.20 and about 5.30 micrometers measured at a distance of eight micrometers from the blade tip, and a thickness of between about 8.40 and about 9.60 micrometers measured at a distance of sixteen micrometers from the blade tip. At least one of an interlayer, coating layer, or overcoat layer is joined to the substrate. In another embodiment, no outer layer is joined to the coated substrate.

A ratio of thickness measured at four micrometers from the blade tip to the thickness measured at eight micrometers from the blade tip is at least 0.55 and a ratio of thickness measured at four micrometers from the blade tip to the thickness measured at sixteen micrometers from the blade tip is at least 0.30.

In yet another embodiment, a razor blade includes a substrate with a cutting edge defined by a sharpened tip, the substrate having a thickness of greater than about 4.26 micrometers measured at a distance of eight micrometers from the blade tip, greater than about 2.30 micrometers measured at a distance of four micrometers from the blade tip, a thickness of a hard coating ranging from about 700 Angstroms to about 3500 Angstroms, and an outer layer being entirely discontinuous or partially discontinuous and partially continuous. The outer layer is produced from a dispersion comprised of about 0.03 g/L or less of telomer. The razor blade is disposed in one or more positions in a razor cartridge.

BRIEF DESCRIPTION OF THE DRAWINGS

While the specification concludes with claims particularly pointing out and distinctly claiming the subject matter that is regarded as the present invention, it is believed that the invention will be more fully understood from the following description taken in conjunction with the accompanying drawings.

FIGS. 4-6, 6A, 6B-1, and 6B-2 are a series of micrographs and tables of the present invention depicting the telomer on razor blade edges.

DETAILED DESCRIPTION OF THE INVENTION

It is generally desirable to provide a razor blade edge in the present invention that increases the force needed to cut through the hair following blade engagement with and penetration into the hair. This type of blade edge is designed to engage and tug at hair, rather than cut cleanly and easily through the hair. These high cut force blade edges can be desirably used to pull hair out of the follicle after engagement with the hair such that a second or other trailing cutting blade in a razor cartridge can cut the hair to capture more hysteresis. This type of blade allows the consumer to increase the time between shaves or to maintain a close shave for longer. This has been shown to be beneficial for instance for shaving legs (e.g., of a female) or other areas with similar hair type and overall area.

The behavior of a blade as it cuts through a hair is defined using a "cutting efficiency" measure known as the single fiber cutter (SFC). This method for measuring the cutting force exerted by a blade on a fiber such as a hair is disclosed in U.S. Pat. No. 9,255,858, issued on Feb. 9, 2016, the Assignee hereof, incorporated by reference in its entirety.

Figure 7:
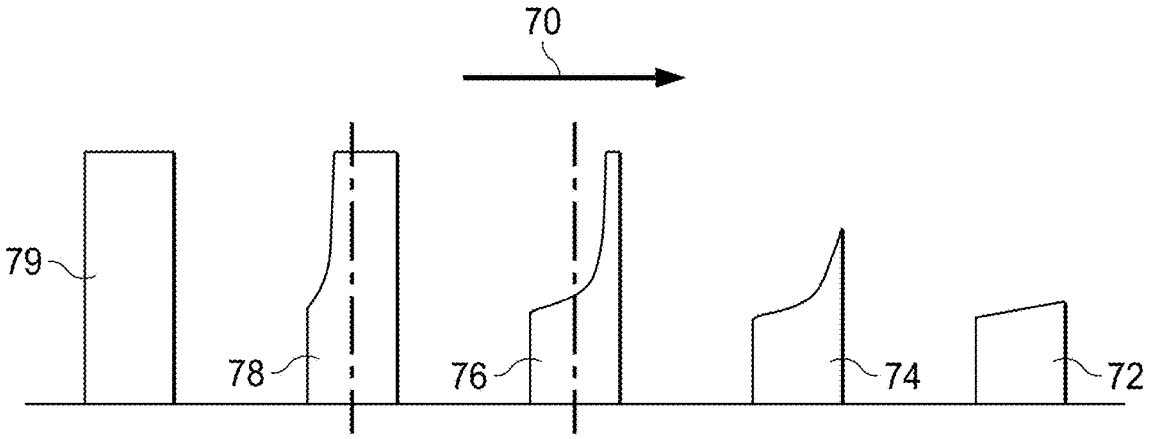
FIG. 7 is a chart of cut indications of hair of the present invention.

Turning first to FIG. 7, as shown, at cut hair indication 72, a blade that has 100% cutting efficiency will provide a clean cut. A clean cut herein signifies cutting right across the hair diameter orthogonal to the axis of the hair and exiting the opposite side of the hair. A blade of the present invention has less than 100% cutting efficiency and will generally not effectively cut directly through the hair (e.g., will not cut right across the hair diameter). For instance, these types of blades will cut the hair in any of the four illustrative scenarios of cut hair indications 74, 76, 78, and 79 shown in FIG. 7 in the cutting direction 70. A blade of the present invention capable of a cut as shown at 74 signifies a cut that will begin transitioning from orthogonal cutting to axial cutting before exiting out of the opposite side of the hair. This may be referred to as a "skive" cut. In this instance, it is also a cut with a side exit. Another blade of the present invention capable of a different type of skive cut is shown at cut hair indication 76, capable of cutting through about half or greater of a hair's diameter before transitioning to predominantly axial cutting (e.g., skiving up the hair but not exiting out of the opposite side of the hair from the point of blade entry). Another blade of the present invention capable of cutting though less than about half of the hair before transitioning to predominantly axial cutting has a cut hair indication as shown at 78 in FIG. 7. A blade of the present invention may also produce a missed cut (e.g., hair may be pushed over by the blade) or one having a negligible visible cut as shown at cut hair indication 79.

Thus, contrary to the principles of operation of the prior art, the present invention describes a novel razor blade that desirably operates at less than 100% cutting efficiency.

There are three solutions in which increased engagement and desirable cutter force can be obtained. The present invention contemplates these solutions can be utilized individually or in any combination. A first solution of the present invention is that of obtaining a sharpened blade edge substrate with a significantly wide substrate profile. This blade edge has thicknesses (e.g., at distances of four, eight, and/or sixteen micrometers from a blade tip) that are much greater than those used in practice as the latter are geared to low cut forces to obtain very sharp blades for ease of cutting, increased closeness and comfort. The thicknesses of these novel blades will be described in more detail below.

A second solution of the present invention includes use of a reduced amount of telomer on the blade edge. Utilizing a reduced amount of telomer, including potentially no telomer, may desirably result in reduced coverage or a discontinuous telomer film on the razor blade edge. This solution is beneficial as it increases the hair cut forces while still maintaining excellent hair engagement/penetration by the blade. By applying a significantly reduced amount of telomer to a blade edge, a non-continuous telomer coating will be achieved, resulting in a much higher cutting force blade edge. The amount of telomer or PTFE present, however, will be sufficient to mitigate skin-related shaving discomfort while also maintaining excellent hair engagement.

In addition to a wide profile and a reduced, discontinuous telomer, a third solution for providing high cut forces of the present invention is to utilize significantly thicker hard coatings in comparison to traditional blades. This type of coating may preferably be a coating comprising carbon, or a carbon containing material such as DLC.

The use of a wider sharpened profile, discontinuous telomer, and thicker hard coating surprisingly results in a blade edge that excels in hysteresis capture type applications.

Figure 1:
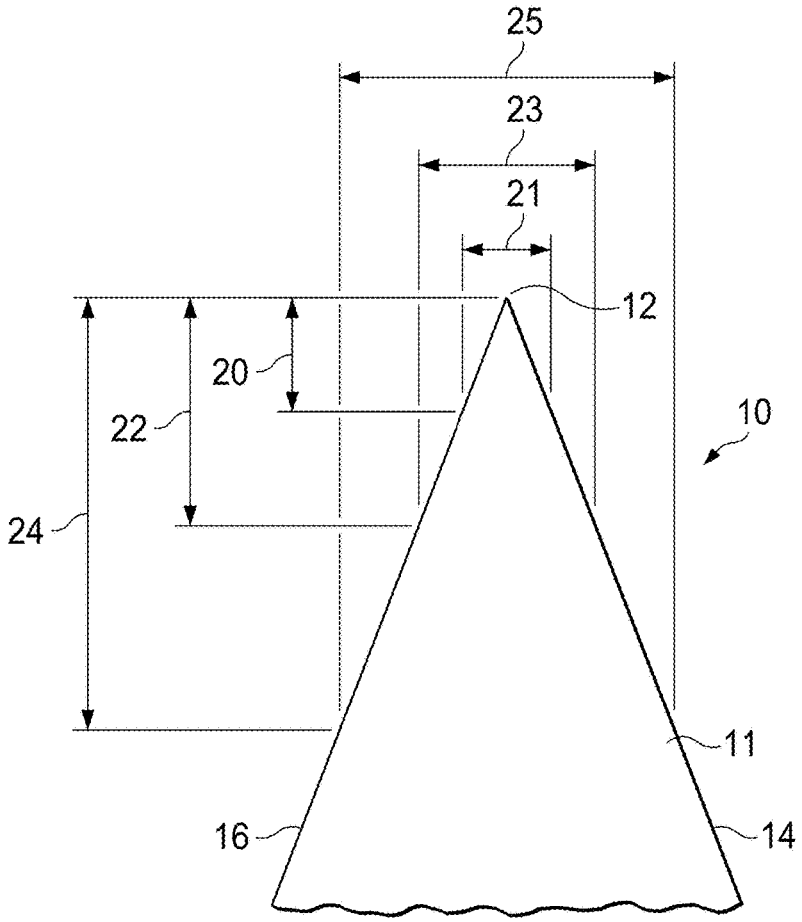
FIG. 1 is a diagrammatic view illustrating a blade substrate.

Referring now to FIG. 1, there is shown a razor blade 10. The razor blade 10 includes a stainless steel body portion or substrate 11 with a wedge-shaped sharpened edge having a tip 12. Tip 12 preferably has a radius of from about 50 to 300 Angstroms with facets 14 and 16 that diverge from tip 12. The substrate 11 has a thickness 21 of greater than about 2.30 micrometers, preferably between about 2.30 and about 3.00 micrometers and more preferably about 2.77 micrometers measured at a distance 20 of four micrometers from the blade tip 12. The substrate 11 has a thickness 23 of greater than about 4.30 micrometers, preferably between about 4.20 and about 5.30 micrometers and more preferably about 5.03 micrometers measured at a distance 22 of eight micrometers from the blade tip 12. The substrate 11 has a thickness 25 of greater than about 7.93 micrometers, preferably between about 8.40 and about 9.60 micrometers and more preferably about 9.08 micrometers measured at a distance 24 of sixteen micrometers from the blade tip 12.

The substrate 11 has a preferable ratio of thickness 21 measured at four micrometers from the tip 12 to the thickness 23 measured at eight micrometers from the tip 12 of at least 0.55.

The substrate 11 has a preferable ratio of thickness 21 measured at four micrometers from the tip 12 to the thickness 25 measured at sixteen micrometers from the tip 12 of at least 0.30.

The thicknesses and ratios of thicknesses provide a framework for shaving and a balance between edge strength and cutting force or sharpness. A substrate having smaller ratios can have inadequate strength leading to ultimate edge failure. A substrate having greater thicknesses can have a higher cutting force leading to an increased tug and pull and increased discomfort for the user during shaving.

One substrate 11 material which may facilitate producing an appropriately engaging edge is a martensitic stainless steel. The material may be comprised of smaller more finely distributed carbides, but with similar overall carbon weight percent. A fine carbide substrate provides for a harder and more brittle after-hardening substrate, and enables the making of a thinner, stronger edge. An example of such a substrate material is a martensitic stainless steel with a finer average carbide size with a carbide density of at least about 200 carbides per square micrometer, more preferably at least about 300 carbides per square micrometer and most preferably at least about 400 carbides or more per 100 square micrometers as determined by optical microscopic cross-section.

Figure 2:
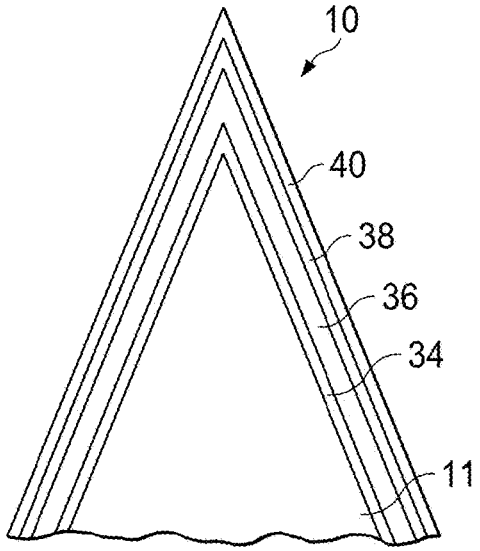
FIG. 2 is a diagrammatic view illustrating a razor blade.
Figure 3:
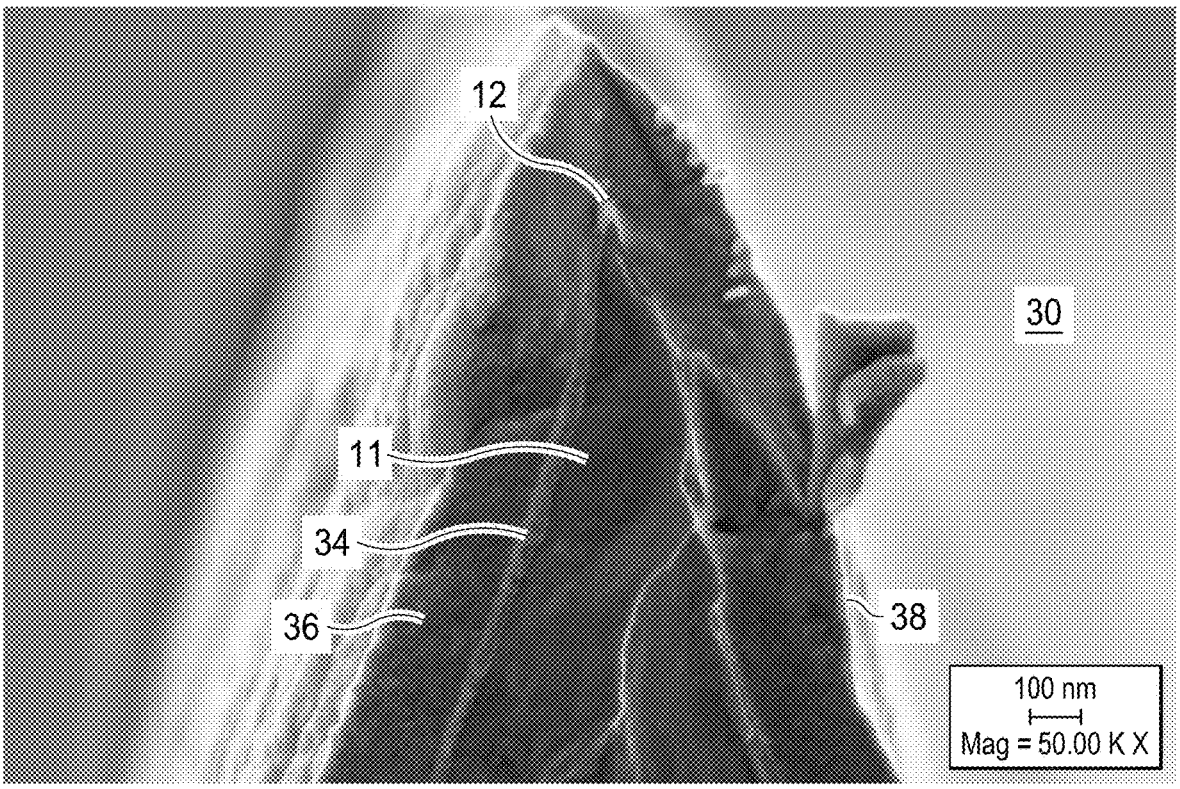
FIG. 3 is a micrograph of a razor blade edge of the present invention.

Referring now to FIGS. 2 and 3, there is shown a diagram and a micrograph of finished blades 10 and 30 respectively, including substrate 11, interlayer 34, hard coating layer 36, overcoat layer 38, and outer layer 30 (the outer layer only deposited in finished blade 10 of FIG. 2). FIG. 3 is shown having no outer layer. The portion of blade 30 shown in the micrograph of FIG. 3 represents a distance of about 1 micrometer back from the blade tip 12. The substrate 11 is typically made of stainless steel though other materials can be employed. An example of a razor blade having a substrate, interlayer, hard coating layer, overcoat layer and outer layer is described in U.S. Pat. No. 6,684,513. The razor blade of the present invention may include a blade without one or more of the various layers joined to the substrate. For instance, the invention contemplates no outer layer. The invention also contemplates no overcoat layer.

Interlayer 34 is used to facilitate bonding of the hard coating layer 36 to the substrate 11. Examples of suitable interlayer material are niobium, titanium and chromium containing material. A particular interlayer is made of niobium greater than about 100 Angstroms and preferably less than about 500 Angstroms thick. The interlayer may have a thickness from about 150 Angstroms to about 350 Angstroms. PCT/US92/03330 describes use of a niobium interlayer.

Hard coating layer 36 provides improved strength, corrosion resistance and shaving ability and can be made from fine-, micro-, or nano-crystalline carbon-containing materials (e.g., diamond, amorphous diamond or DLC), nitrides (e.g., boron nitride, niobium nitride, chromium nitride, zirconium nitride, or titanium nitride), carbides (e.g., silicon carbide), oxides (e.g., alumina, zirconia) or other ceramic materials (including nanolayers or nanocomposites). The carbon containing materials can be doped with other elements, such as tungsten, titanium, silver, or chromium by including these additives, for example in the target during application by sputtering. The materials can also incorporate hydrogen, e.g., hydrogenated DLC. Preferably coating layer 36 is made of diamond, amorphous diamond or DLC. The present invention includes a hard coating of greater than about 700 Angstroms, preferably in a range from about 2000 to about 3500 Angstroms, and most preferably about 2100 Angstroms. This thickness range provides a benefit of edge strength and durability in particular for high cut force blade edges.

In a preferred embodiment the hard coating is comprised of carbon or a carbon containing material. In a preferred embodiment this material is DLC. DLC layers and methods of deposition are described in U.S. Pat. No. 5,232,568. As described in the "Handbook of Physical Vapor Deposition (PVD) Processing, "DLC is an amorphous carbon material that exhibits many of the desirable properties of diamond but does not have the crystalline structure of diamond."

Overcoat layer 38 is used to reduce the tip rounding of the hard coated edge and to facilitate bonding of the outer layer to the hard coating while still maintaining the benefits of both. Overcoat layer 38 is preferably made of chromium containing material, e.g., chromium or chromium alloys or chromium compounds that are compatible with polytetrafluoroethylene, e.g., Chromium Platinum or CrPt. A particular overcoat layer may have a thickness of from about 50 Angstroms to about 500 Angstroms, preferably from about 100 Angstroms to about 300 Angstroms. Razor blade 10 has a cutting edge that has less rounding with repeated shaves than it would have without the overcoat layer.

Outer layer 40 is generally used to provide reduced friction but in the present invention is used to help ensure successful engagement of the blade with the hair but also to obtain some tugging and pulling to provide hair extension. The outer layer 40 may desirably be a soft coating such as a polymer composition or a modified polymer composition. The polymer composition may be polyfluorocarbon. A suitable polyflourocarbon is polytetrafluoroethylene sometimes referred to as a telomer or PTFE. Particular polytetrafluoroethylene materials are Krytox LW-1200 or Krytox LW-2120 available from Chemours, formerly DuPont. These types of material are nonflammable and stable dry lubricants that consists of small particles that yield stable dispersions. This material is utilized as an aqueous dispersion of less than 2% solids by weight of composition of telomer, more preferably about 0.5% solids or less of telomer by weight of composition, and most preferably about 0.0004% solids or less of telomer by weight of composition, including no telomer solid, and can be applied by dipping, spraying, printing, or brushing, and can thereafter be air dried or melt coated (e.g., sintered). The present invention contemplates utilizing highly diluted telomer dispersion. The application of the telomer is preferably produced by depositing the material on the razor blade edge utilizing a spray process. The novel amount of telomer in the telomer dispersion ranges between about 0.01 g/L to about 0.06 g/L and may preferably be about 0.0307 g/L.

The resulting telomer outer layer is preferably about 3,500 Angstroms after deposition onto the razor blade and as thin as about 100 Angstroms (e.g., in one instance, if reduced).

The blade edge of the present invention is preferably comprised of an outer layer 40 that is discontinuous in portions of the blade edge with some areas of continuous telomer, or entirely discontinuous. The present invention also contemplates no outer layer (e.g., no telomer). The term "discontinuous" as used herein signifies that the outer layer is characterized by interruptions or breaks such that it is not a uniform layer. In another embodiment of the present invention the outer layer is comprised of a partially continuous and partially discontinuous layer in that the soft coating layer is desirably continuous on certain portions of the blade edge and discontinuous in other portions. The soft coating is desirably continuous along the ultimate tip or near the cutting edge and discontinuous further down the facets 14 and 16. If entirely discontinuous, the soft coating outer layer is discontinuous throughout all portions. In either instance, the discontinuous nature of the outer layer soft coating may be random, ordered, semi-ordered, or any combination thereof.

As described in U.S. Pat. No. 5,985,459, issued on Nov. 16, 1999, and herein incorporated in its entirety, the beads of liquid shown in FIGS. 4, 5 and 6 are silicone oil demonstrating that the metal surface still retains some PTFE coating and also demonstrating the generally varied nature of the discontinuous outer layer.

Figure 4:
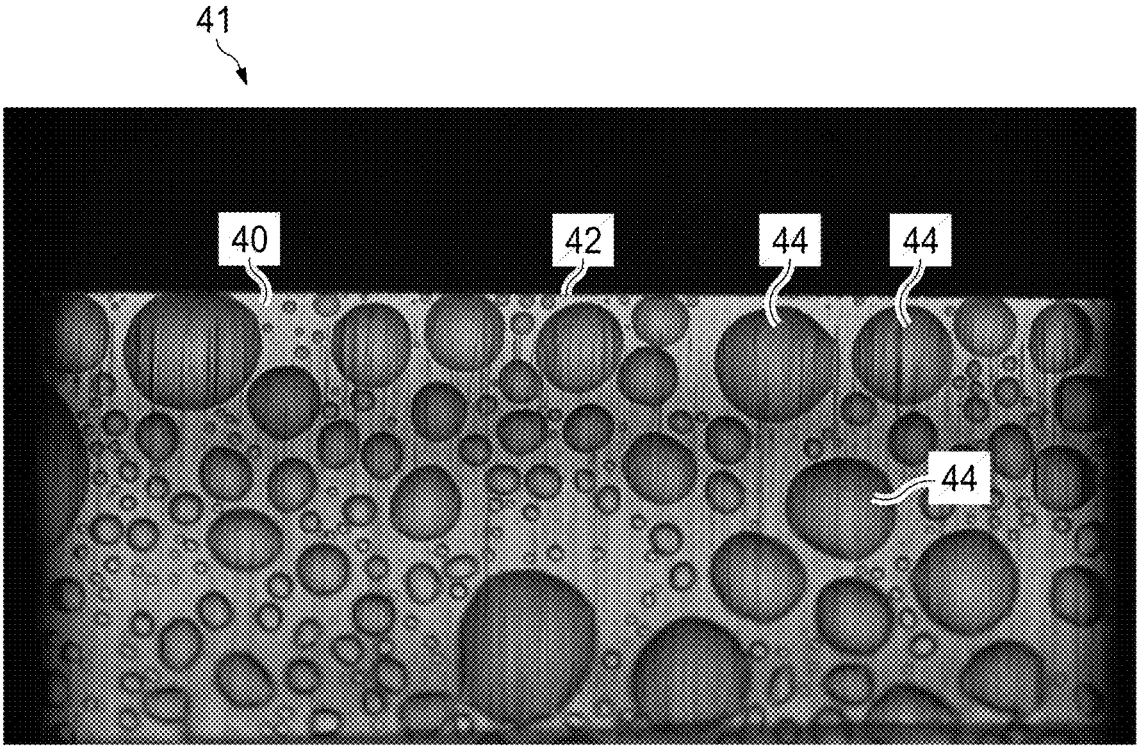

In FIG. 4, a micrograph 41 depicts silicone oil droplets 44 deposited onto an outer layer 40 of a blade edge tip 42. Due to the generally clearly defined and uniform spherical shape of the silicone oil droplets 44, the telomer coverage is considered to be substantially continuous.

Figure 5:
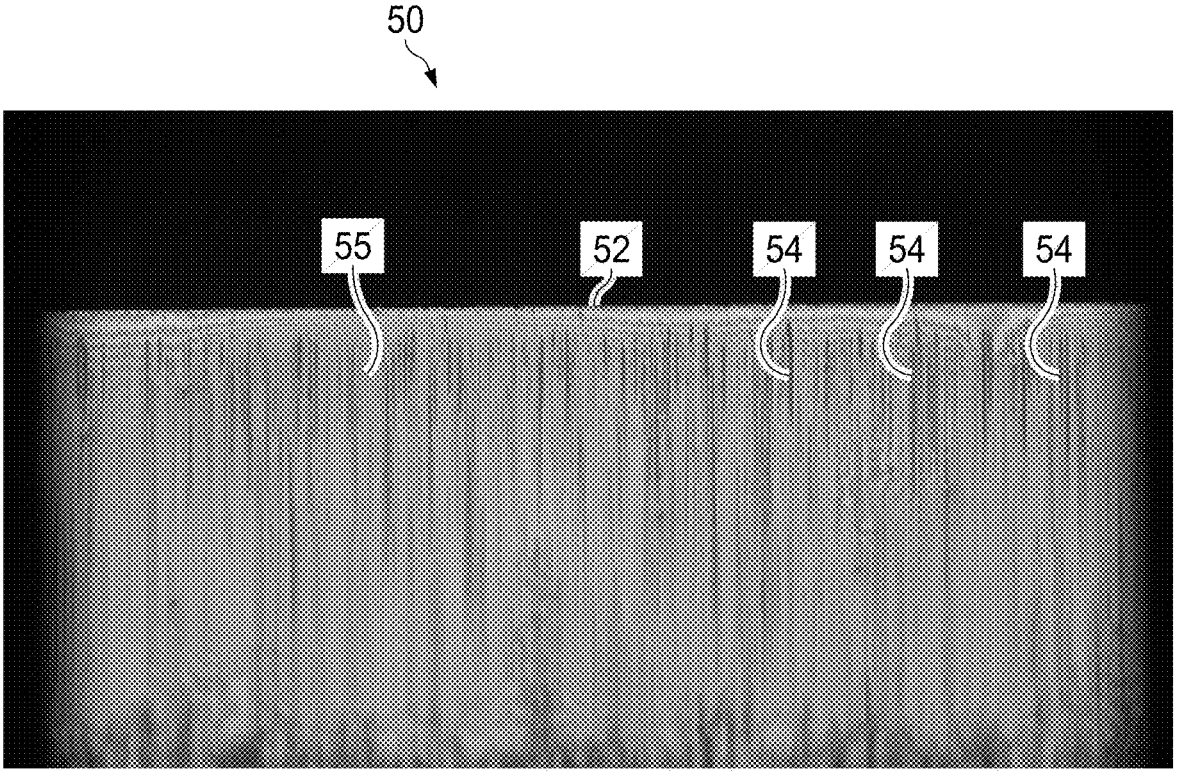

In FIG. 5, a micrograph 50 of the present invention depicts silicone oil 54 after droplets have been deposited on a tip 52 of a blade edge 55. Due to the lack of shape of definition and lack of uniformity of the oil (e.g., the droplets of silicone oil have substantially spread out and are generally flattened out across the razor blade edge 55), the blade edge is considered to have no outer layer of telomer.

Figure 6:
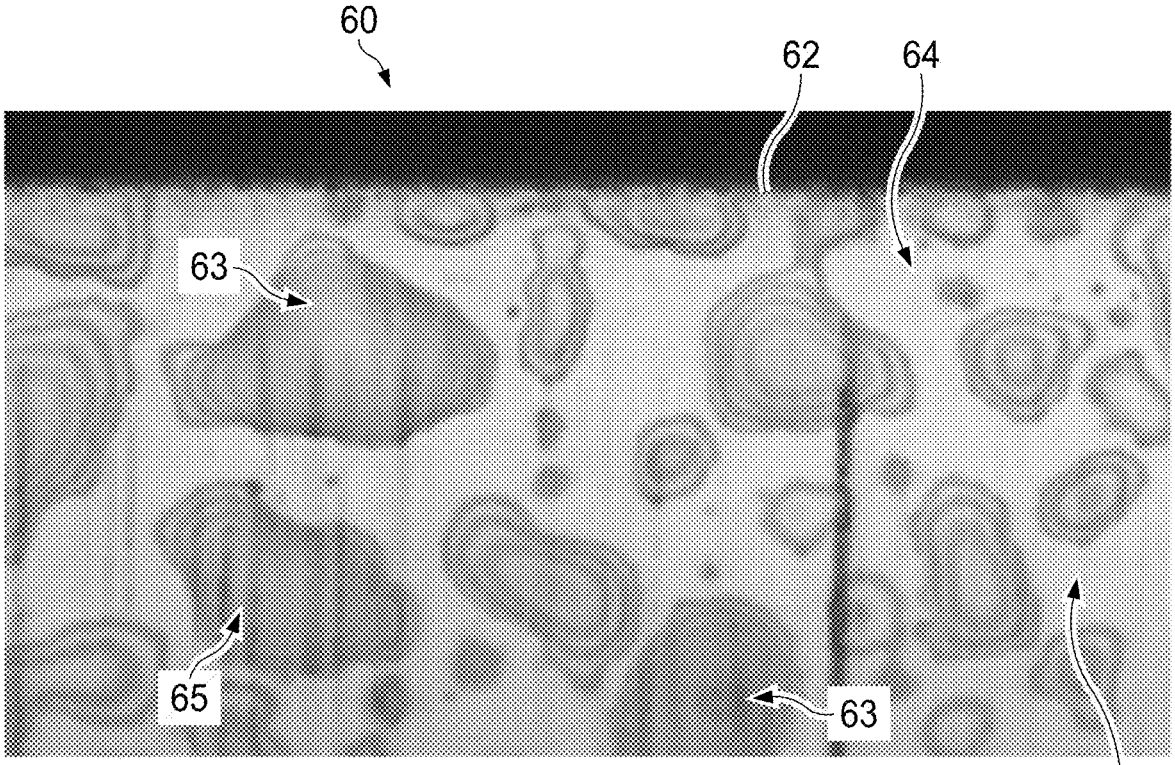

In FIG. 6, a micrograph 60 of the present invention depicting silicone oil droplets deposited on an outer layer of the present invention blade edge 60. Due to the non-uniform shapes and lack of definition of the silicone oil droplets, the telomer coverage of FIG. 6 is considered to be discontinuous. For instance, as shown, telomer areas 64 start from a blade tip 62 and extend throughout the blade. Areas 64 represents portions of the blade where silicone oil was not applied. Area 63 and 65 shows silicone oil spreading on the blade edge indicating the absence of some telomer in certain areas.

Figure 6A:
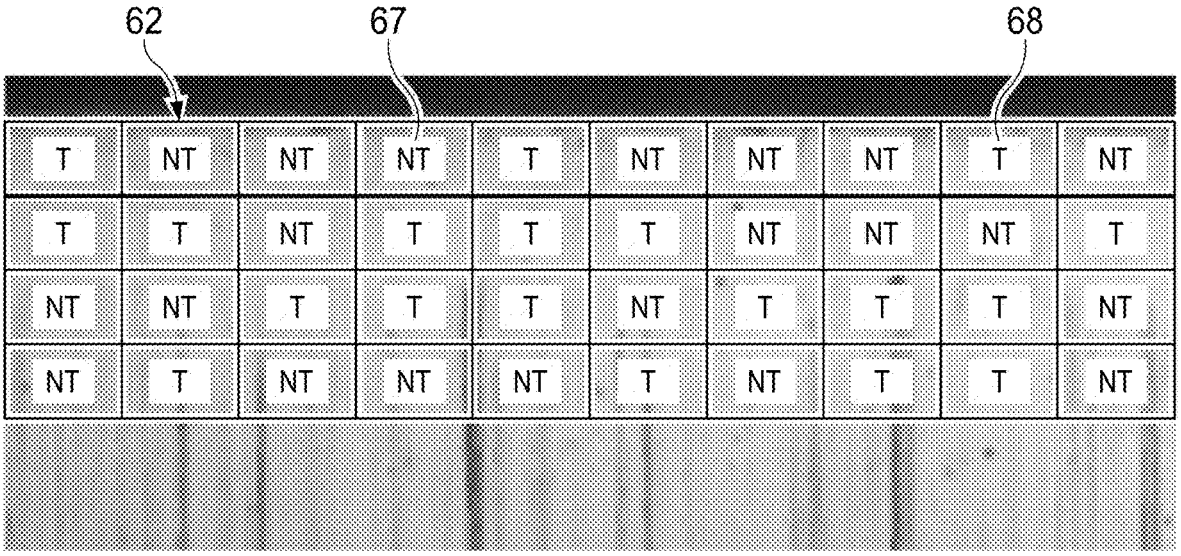

In FIG. 6A, a table 62 of the present invention is shown which depicts the regions of telomer in the blade of FIG. 6. The table 62 can be visualized as overlying the micrograph of FIG. 6. The table 62 has squares with either the letters "T" or "NT" in the rows and columns to designate the areas of telomer and no telomer, respectively, on the blade edge area shown in FIG. 6. As shown in FIG. 6A, a first row of table 62 indicates that there are both telomer (T) and non-telomer (NT) regions in the area closest to the blade tip of FIG. 6. Thus the present invention contemplates a blade edge having an outer layer with a mix of telomer areas and non-telomer areas. One arrangement contemplated in the present invention may be horizontal telomer regions or bands starting at the blade tip followed by an area with substantially no telomer which extends to unsharpened areas of the blade edge.

Figures 1, 6B:
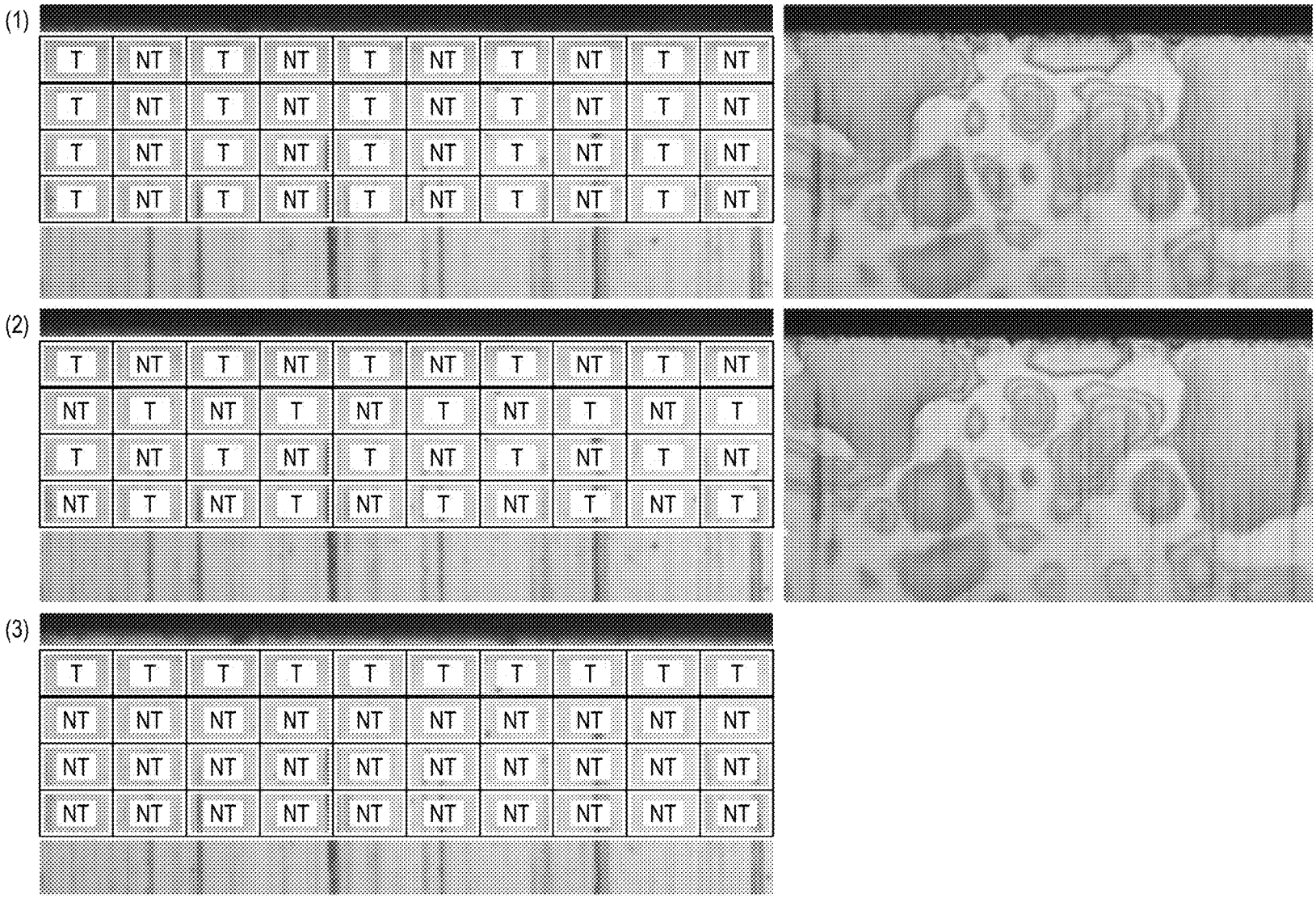
Figures 2, 6B:
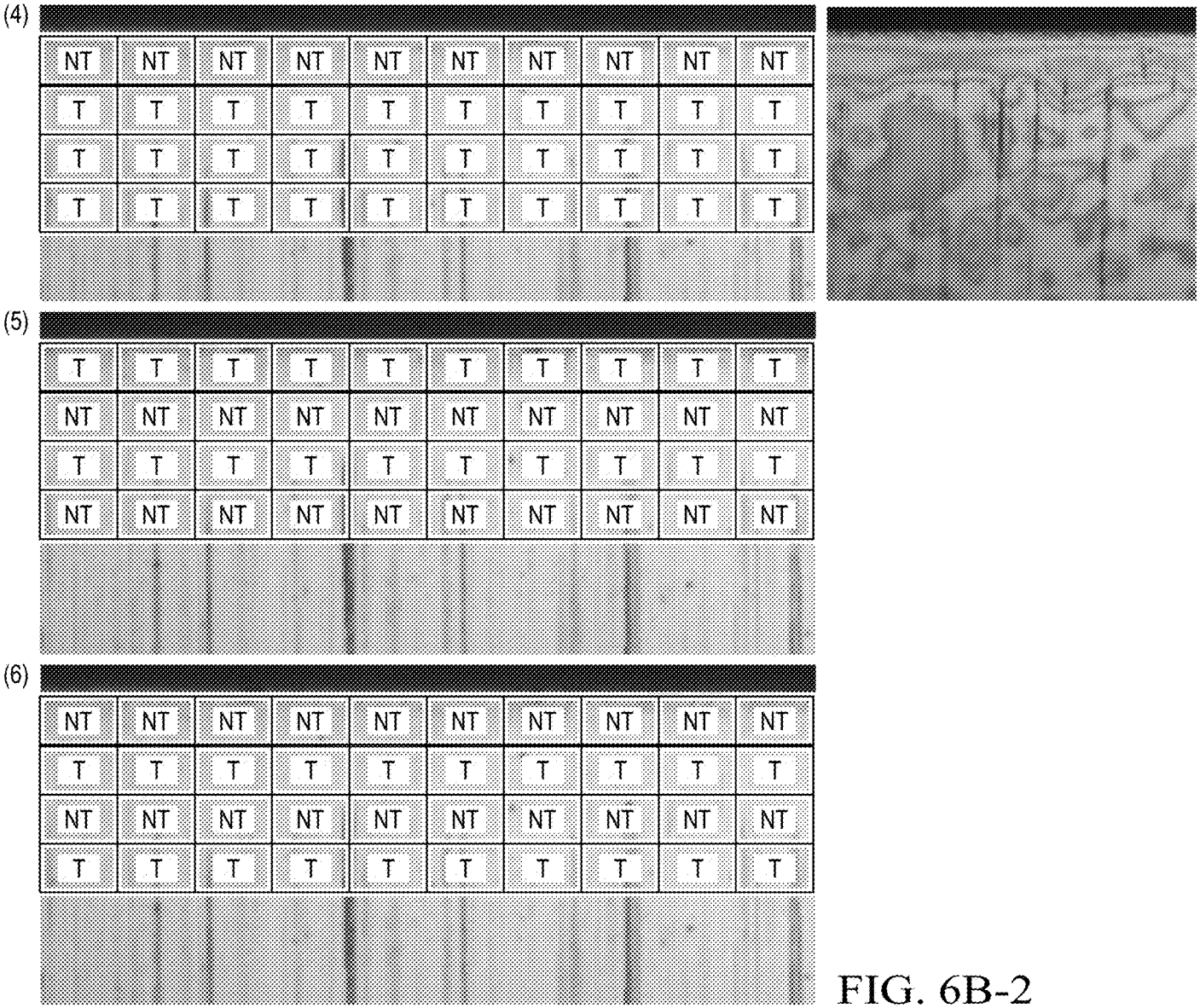

Various other contemplated embodiments of telomer regions of the present invention across a blade area are shown in tables (1) to (3) of FIG. 6B-1 and tables (4) to (6) of FIG. 6B-2 along with related micrographs.

Thus, while past known art explicitly desires formation of uniform soft coatings avoiding conditions and/or processes which formed discontinuous (e.g., non-uniform) telomer coverage, the present invention enhances such conditions and/or processes, while maintaining telomer adhesion and providing excellent blade engagement with the hair.

Provided that a soft coating is achieved on the blade edge, the telomer coating thickness can be further reduced, if desired. U.S. Pat. Nos. 5,263,256 and 5,985,459, which are hereby incorporated by reference, describe techniques which can be used to reduce even further the thickness of an applied telomer layer.

Razor blade 10 or 30 is made generally according to the processes described in the above referenced patents. A particular embodiment includes a niobium interlayer 34, DLC hard coating layer 36, chromium overcoat layer 38, and Krytox LW-1200 or Krytox LW-2120 polytetrafluoroethylene outer coat layer 40. Chromium overcoat layer 38 is deposited to a minimum of 100 Angstroms and a maximum of 500 Angstroms. It is deposited by sputtering using a DC bias (more negative than −50 volts and preferably more negative than −200 volts) and pressure of about 2 millitorr argon. The increased negative bias is believed to promote a compressive stress (as opposed to a tensile stress), in the chromium overcoat layer which is believed to promote improved resistance to tip rounding while maintaining good shaving performance. Finished razor blade 30 of FIG. 3 preferably has a tip radius of about 50 to about 400 Angstroms, measured by SEM after application of overcoat layer 38.

The substrate profile of the razor blade of the present invention provides an improvement in engagement and tug and pull. The blade sharpness may be quantified by measuring cutting force, which correlates with sharpness. Cutting force is measured by the wool felt cutter test, which measures the cutting forces of the blade by measuring the force required by each blade to cut through wool felt. Each blade is run through the wool felt cutter 5 times and the force of each cut is measured on a recorder. The lowest of 5 cuts is defined as the cutting force.

The finished blade 10 has cutter force of greater than about 2.00 lbs, preferably greater than about 3.30 lbs. This may be considered to be a relatively high cut force blade and thus, a less efficient cutting blade as desired in the present invention.

Figure 8:
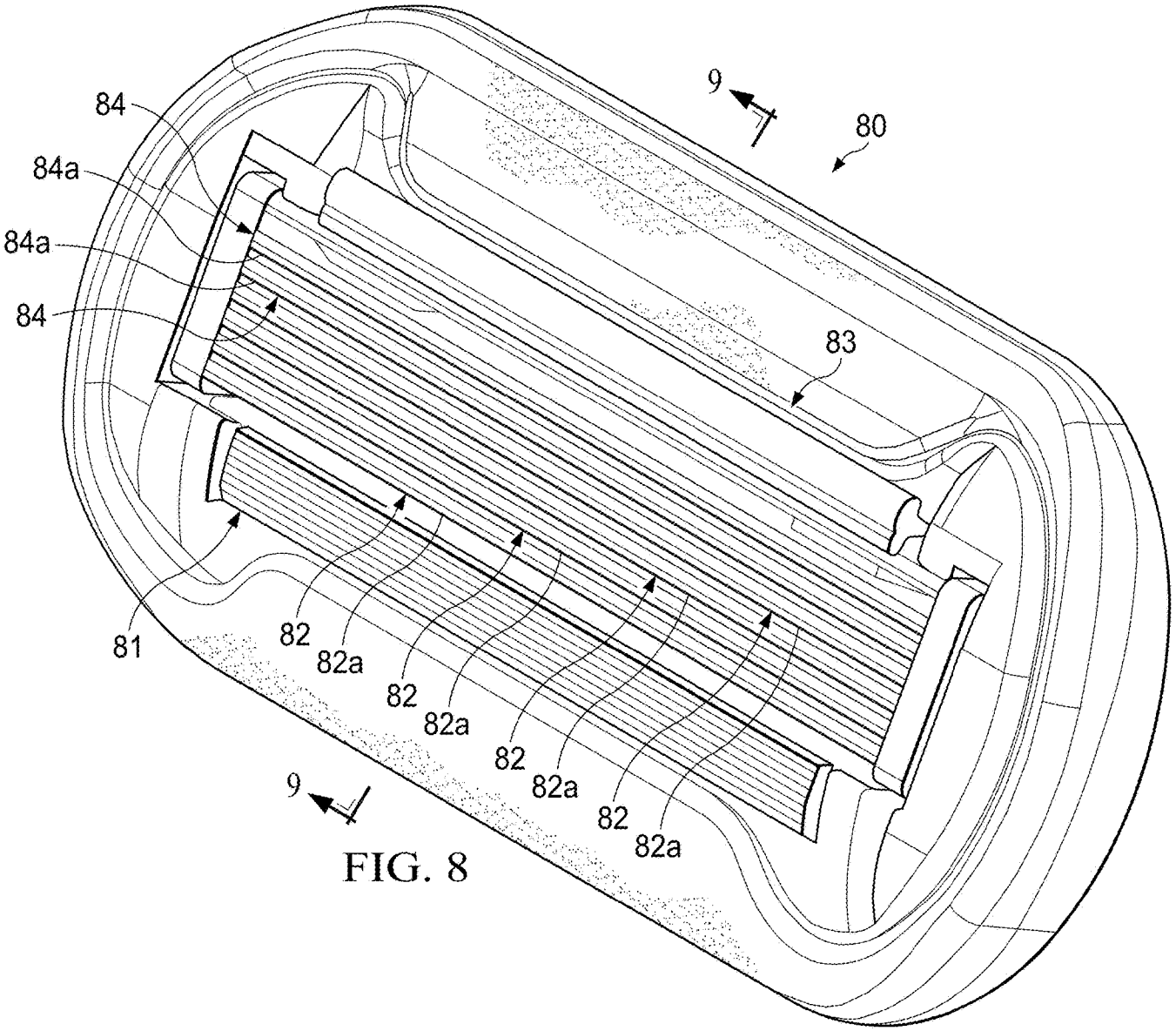
FIG. 8 is a perspective top view of a razor cartridge having at least one razor blade of the present invention disposed therein.

Referring now to FIG. 8, a razor cartridge 80 of the present invention is shown having the razor blades 82 of the present invention, with cutting edges 82*a* of the type described herein. In the present invention, it is desirable to have razor blades 82 with the cutting edges 82*a* of the present invention disposed toward the front area 81 of the razor cartridge 80. It is also desirable to have sharper blades 84 having edges 84*a* with lower cutting forces towards the rear area 83 of the razor cartridge 80. This arrangement allows the novel cutting edges 82*a* of blades 82 to engage the hair (e.g., tugging and pulling the hairs out), while allowing trailing blades 84 to provide clean cuts.

Figure 9:
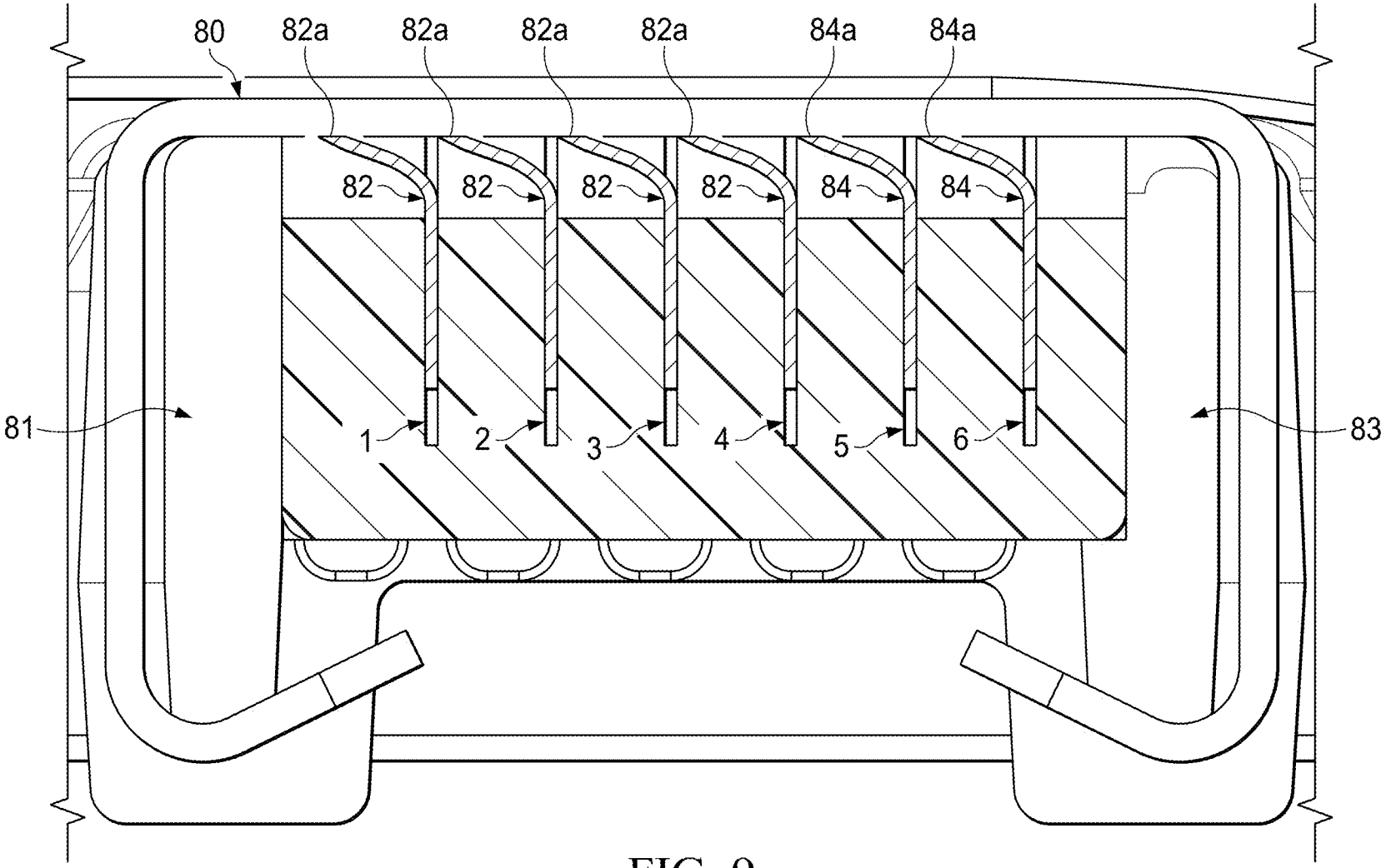
FIG. 9 is a cross-sectional view of the razor cartridge of FIG. 8.

As shown in the cross-sectional view of FIG. 8, in FIG. 9, blades 82 of the present invention are disposed in positions 1, 2, 3, and 4 (e.g., towards the front area 81) of the cartridge 80 and blades 84 are disposed in positions 5 and 6 (e.g., towards the rear area 83) of the razor cartridge 80. While the razor blade of the present invention is contemplated as being disposed in any position in the razor cartridge, it is desirable that a blade 82 with edge 82*a* of the present invention is disposed in the first (e.g., in position 1), of the razor cartridge or any of the first few positions in the blade area. If disposed in any of the positions in the front area, this blade will be the first blade or one of the first blades to engage with hair. The blade 82 with edge 82*a* may be disposed in one, two, three, or all four positions, or any combination thereof, of positions 1, 2, 3 and 4 (the latter arrangement of all four positions 1-4 being shown in FIG. 9) of the razor cartridge in accordance with the present invention. The blade 82 with edge 82*a* may be disposed in any one, two, three, four, five, or all six positions of positions 1, 2, 3, 4, 5, and 6, or any combination thereof, of the razor cartridge in accordance with the present invention.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A razor blade comprising:

a substrate with a cutting edge being defined by a sharpened tip, said substrate having a thickness of greater than 4.26 micrometers measured at a distance of eight micrometers from the blade tip.

2. The razor blade of claim 1 wherein said substrate has a thickness of greater than 2.30 micrometers measured at a distance of four micrometers from the blade tip.

3. The razor blade of claim 2, wherein said substrate has a thickness of 2.77 micrometers measured at a distance of four micrometers from the blade tip.

4. The razor blade of claim 1 wherein said substrate has a thickness of greater than 7.93 micrometers measured at a distance of sixteen micrometers from the blade tip.

5. The razor blade of claim 4, wherein said substrate has a thickness of 9.08 micrometers measured at a distance of four micrometers from the blade tip.

6. The razor blade of claim 4 wherein a ratio of thickness measured at four micrometers from the blade tip to the thickness measured at eight micrometers from the blade tip is at least 0.55 and a ratio of thickness measured at four micrometers from the blade tip to the thickness measured at sixteen micrometers from the blade tip is at least 0.30.

7. The razor blade of claim 1, wherein said substrate has a thickness of 5.00 micrometers measured at a distance of eight micrometers from the blade tip.

8. The razor blade of claim 1, wherein the substrate has a tip radius of from 50 to 300 Angstroms.

9. The razor blade of claim 1 further comprising an interlayer joined to said substrate.

10. The razor blade of claim 9 wherein said interlayer comprises niobium or chromium.

11. The razor blade of claim 9, further comprising a coating layer joined to said interlayer.

12. The razor blade of claim 11 wherein said coating layer comprises carbon.

13. The razor blade of claim 12 wherein said coating layer is comprised of DLC.

14. The razor blade of claim 13 wherein a thickness of said DLC ranges from 700 Angstroms to 3500 Angstroms.

15. The razor blade of claim 14 wherein said razor blade is disposed within a razor cartridge.

16. The razor blade of claim 11 further comprising an overcoat layer joined to said coating layer.

17. The razor blade of claim 16 wherein said overcoat layer comprises chromium.

18. The razor blade of claim 16 wherein a tip radius of the substrate with the coating layer is 50 Angstroms to 400 Angstroms.

19. The razor blade of claim 18 wherein said outer layer is produced from a dispersion comprising of 0.5% solids or less by weight of composition of telomer.

20. The razor blade of claim 18 wherein said outer layer is produced from a dispersion comprising 0.03 g/L or less of telomer.

21. The razor blade of claim 18 wherein a thickness of said outer layer is 100 Angstroms.

22. The razor blade of claim 16 further comprising an outer layer joined to said overcoat layer.

23. The razor blade of claim 22 wherein said outer layer comprises a polymer.

24. The razor blade of claim 23 wherein said outer layer is discontinuous.

25. The razor blade of claim 23 wherein said polymer comprises polytetrafluoroethylene.

26. The razor blade of claim 25 wherein said outer layer is comprised of a random, ordered, semi-ordered, or any combination thereof, discontinuous layer.

27. The razor blade of claim 25 wherein a wool felt cut force of said razor blade is greater than 2 lbs.

28. The razor blade of claim 25 wherein said razor blade is disposed within a razor cartridge.

29. The razor blade of claim 1 cutting at less than 100% cutting efficiency using a single fiber cutting efficiency measure.

30. The razor blade of claim 1 wherein said substrate is a martensitic stainless steel.

31. The razor blade of claim 1 wherein said razor blade is disposed within a razor cartridge.

32. A razor blade comprising:

a substrate with a cutting edge being defined by a sharpened tip, said substrate having a thickness of between 2.30 and 3.00 micrometers measured at a distance of four micrometers from the blade tip, a thickness of between 4.20 and 5.30 micrometers measured at a distance of eight micrometers from the blade tip, and a thickness of between 8.40 and 9.60 micrometers measured at a distance of sixteen micrometers from the blade tip.

33. The razor blade of claim 32 wherein at least one of an interlayer, coating layer, or overcoat layer is joined to said substrate.

34. The razor blade of claim 32 wherein no outer layer is joined to said coated substrate.

35. The razor blade of claim 32 wherein a ratio of thickness measured at four micrometers from the blade tip to the thickness measured at eight micrometers from the blade tip is at least 0.55 and a ratio of thickness measured at four micrometers from the blade tip to the thickness measured at sixteen micrometers from the blade tip is at least 0.30.

36. A razor blade comprising:

a substrate with a cutting edge defined by a sharpened tip, said substrate having a thickness of greater than 2.30 micrometers measured at a distance of four micrometers from the blade tip, a thickness of greater than 4.26 micrometers measured at a distance of eight micrometers from the blade tip, a thickness of greater than 7.93 micrometers measured at a distance of sixteen micrometers from the blade tip, a thickness of a hard coating ranging from 700 Angstroms to 3500 Angstroms, and an outer layer being entirely discontinuous or partially discontinuous and partially continuous.

37. The razor blade of claim 36 wherein said outer layer is produced from a dispersion comprising of 0.03 g/L or less of telomer.

38. The razor blade of claim 37 disposed in one or more positions in a razor cartridge.

* * * * *